US009073370B1

(12) United States Patent
Takabatake et al.

(10) Patent No.: US 9,073,370 B1
(45) Date of Patent: Jul. 7, 2015

(54) PRINTER

(71) Applicant: FUJITSU COMPONENT LIMITED, Tokyo (JP)

(72) Inventors: Yoshinari Takabatake, Tokyo (JP); Sumio Watanabe, Tokyo (JP); Yukihiro Mori, Tokyo (JP); Masafumi Chiba, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/627,162

(22) Filed: Feb. 20, 2015

(30) Foreign Application Priority Data

Feb. 28, 2014 (JP) ..... 2014-039622

(51) Int. Cl.
*B41J 29/02* (2006.01)
*B41J 29/00* (2006.01)
*B41J 11/70* (2006.01)

(52) U.S. Cl.
CPC *B41J 11/70* (2013.01); *B41J 29/02* (2013.01); *B41J 29/00* (2013.01)

(58) Field of Classification Search
USPC ..... 347/101, 104, 220, 222; 400/621
See application file for complete search history.

(56) References Cited

U.S. PATENT DOCUMENTS

| | | | | |
|---|---|---|---|---|
| 8,411,119 | B2 | 4/2013 | Tsuchiya et al. | |
| 2010/0232092 | A1 | 9/2010 | Sakamoto | |
| 2011/0026999 | A1* | 2/2011 | Kohira | 400/621 |

FOREIGN PATENT DOCUMENTS

| | | |
|---|---|---|
| JP | 2010-173129 | 8/2010 |
| JP | 2010-214658 | 9/2010 |

* cited by examiner

*Primary Examiner* — Huan Tran
(74) *Attorney, Agent, or Firm* — IPUSA, PLLC

(57) ABSTRACT

A printer includes a printer body, a lid, a cutter, a fixed blade unit, and a movable blade unit. The printer body includes a print head, a recording paper holder in which recording paper is placed, and a metal member fixed to the recording paper holder. The lid is connected to the printer body so as to be opened and closed relative to the printer body. The cutter cuts the recording paper. The fixed blade unit is provided on the metal member of the printer body and includes a fixed blade of the cutter. The movable blade unit is provided on the lid and includes a movable blade of the cutter.

3 Claims, 12 Drawing Sheets

PRINTER

CROSS-REFERENCE TO RELATED APPLICATION

The present application is based upon and claims the benefit of priority of Japanese Patent Application No. 2014-039622, filed on Feb. 28, 2014, the entire contents of which are incorporated herein by reference.

BACKGROUND OF THE INVENTION

1. Field of the Invention

The present invention relates to printers.

2. Description of the Related Art

Printers that output receipts are widely used for shop registers and automated teller machines (ATMs) or cash dispensers (CDs) in banks. In such printers that output receipts, printing is performed on thermal paper that serves as recording paper or sheets with a thermal head while conveying the recording paper, and after conveying the recording paper a predetermined length, the recording paper is cut by a cutter to the predetermined length. Such a cutter includes a fixed blade and a movable blade, and the movable blade moves toward the fixed blade so as to cut the recording paper held between the fixed blade and the movable blade.

Such printers include clamshell printers. Clamshell printers include a printer body and a lid that is connected to the printer body in such a manner as to be openable and closable relative to the printer body. By closing the lid after loading a roll of recording paper into the printer body, printing is ready to be performed on the recording paper. Clamshell printers as well include a cutter for cutting the recording paper. Because the recording paper is held and cut between the fixed blade and the movable blade of the cutter, one of the fixed blade and the movable blade is provided in the printer body and the other is provided on the lid. Therefore, according to clamshell printers, by closing the lid, the fixed blade and the movable blade are placed at predetermined positions where the fixed blade and the movable blade function as a cutter, so that the recording paper is ready to be cut with the fixed blade and the movable blade.

Reference may be made to Japanese Laid-Open Patent Applications No. 2010-173129 and No. 2010-214658.

SUMMARY OF THE INVENTION

According to an aspect of the present invention, a printer includes a printer body, a lid, a cutter, a fixed blade unit, and a movable blade unit. The printer body includes a print head, a recording paper holder in which recording paper is placed, and a metal member fixed to the recording paper holder. The lid is connected to the printer body so as to be opened and closed relative to the printer body. The cutter cuts the recording paper. The fixed blade unit is provided on the metal member of the printer body and includes a fixed blade of the cutter. The movable blade unit is provided on the lid and includes a movable blade of the cutter.

DESCRIPTION OF THE EMBODIMENTS

Figure 1:
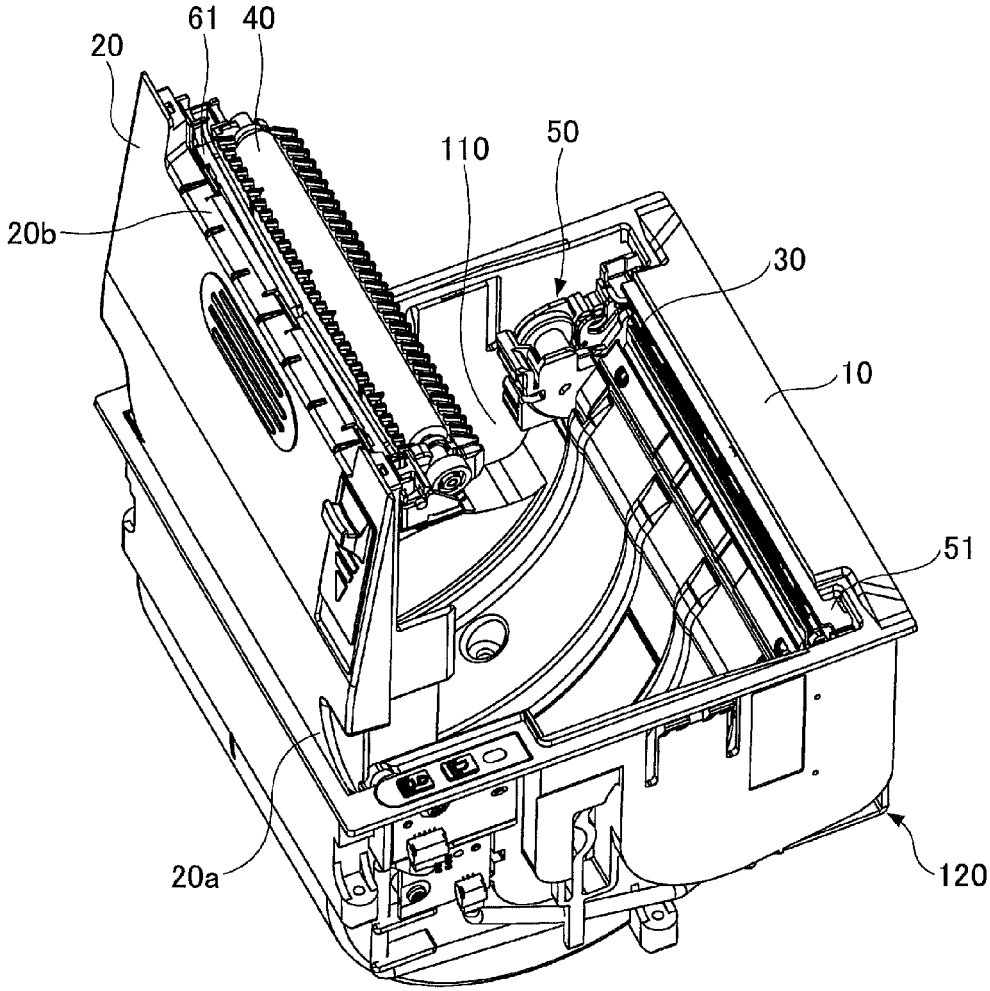
FIG. 1 is a perspective view of a printer with a lid opened according to an embodiment.

One or more embodiments of the present invention are described below with reference to the accompanying drawings. The same elements are referred to by the same reference numeral, and are not further described.

A printer according to an embodiment is described with reference to FIGS. 1 through 4.

Figure 2:
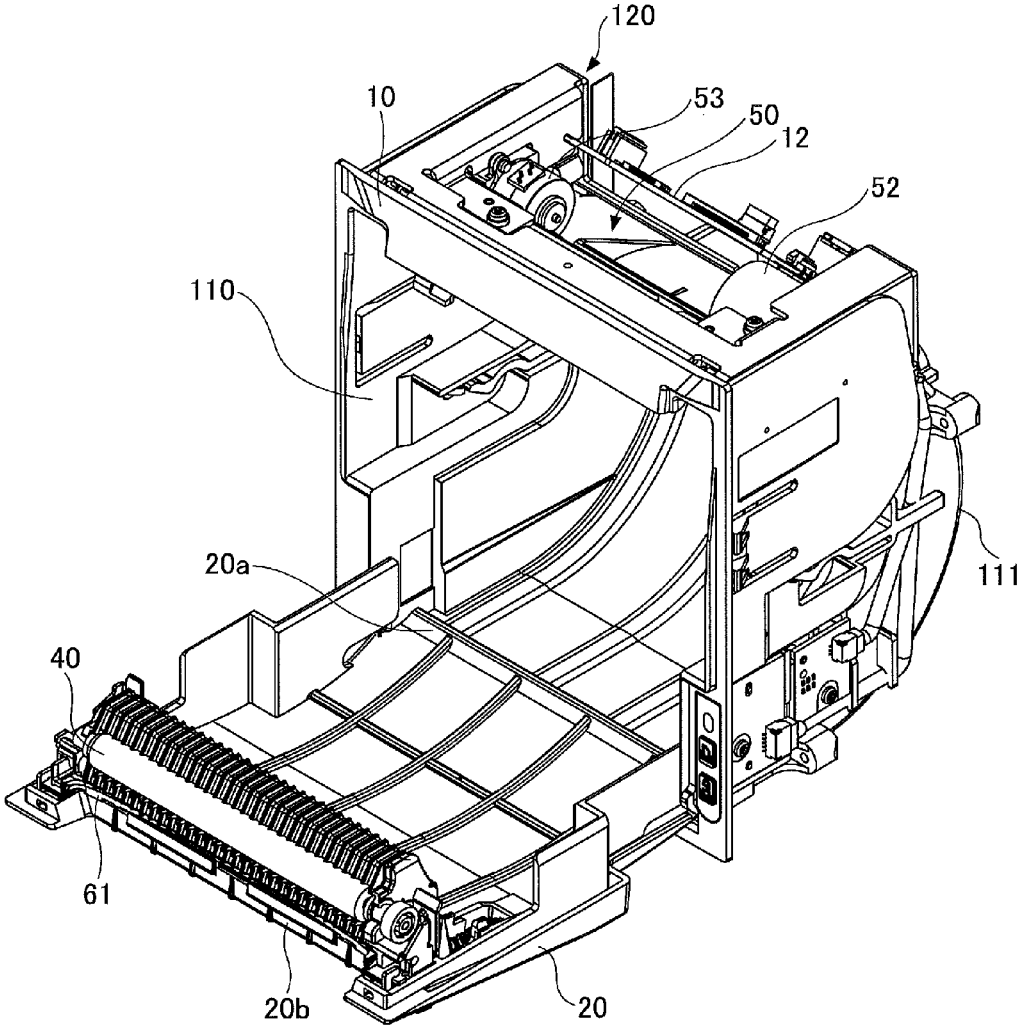
FIG. 2 is a perspective view of the printer with the lid opened according to the embodiment.
Figure 3:
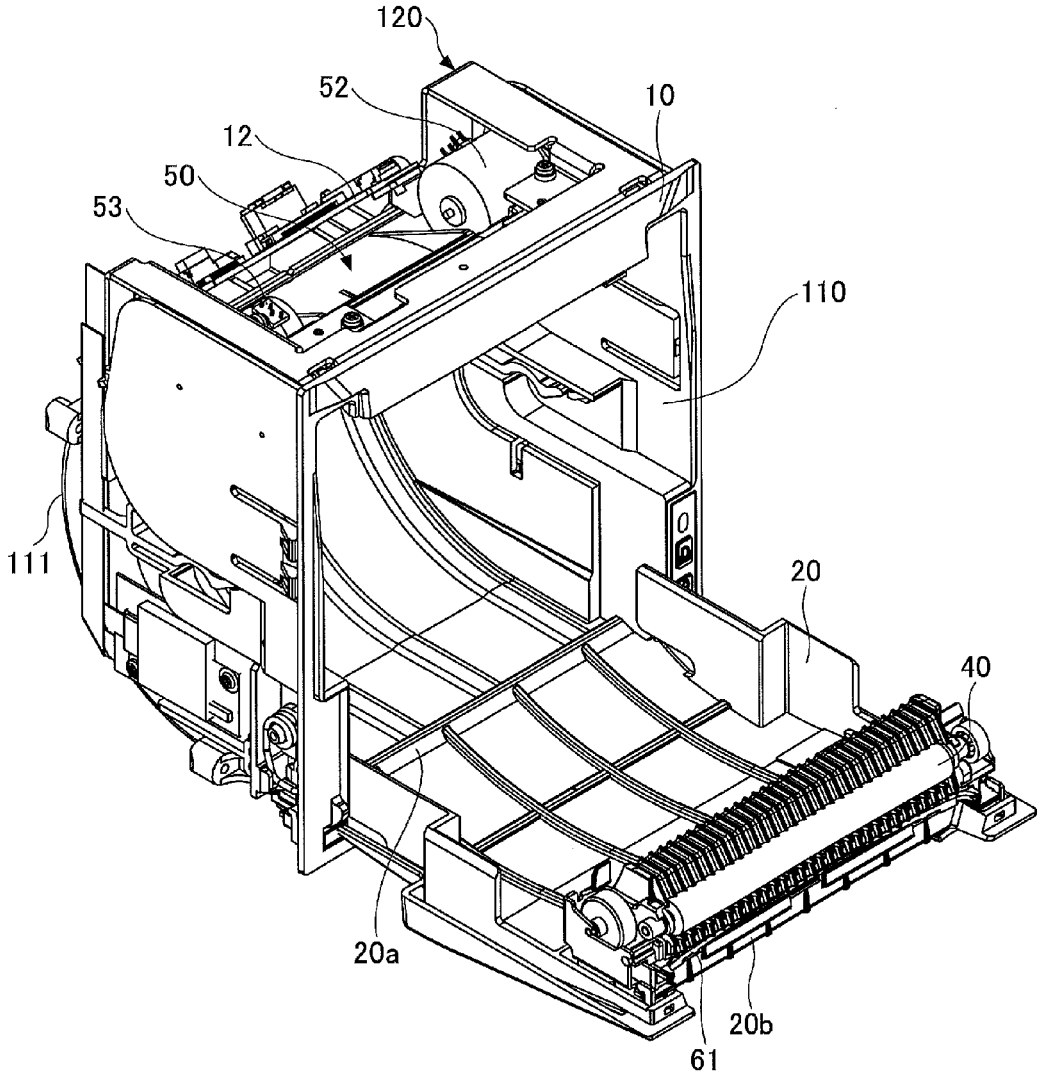
FIG. 3 is a perspective view of the printer with the lid opened according to the embodiment.
Figure 4:
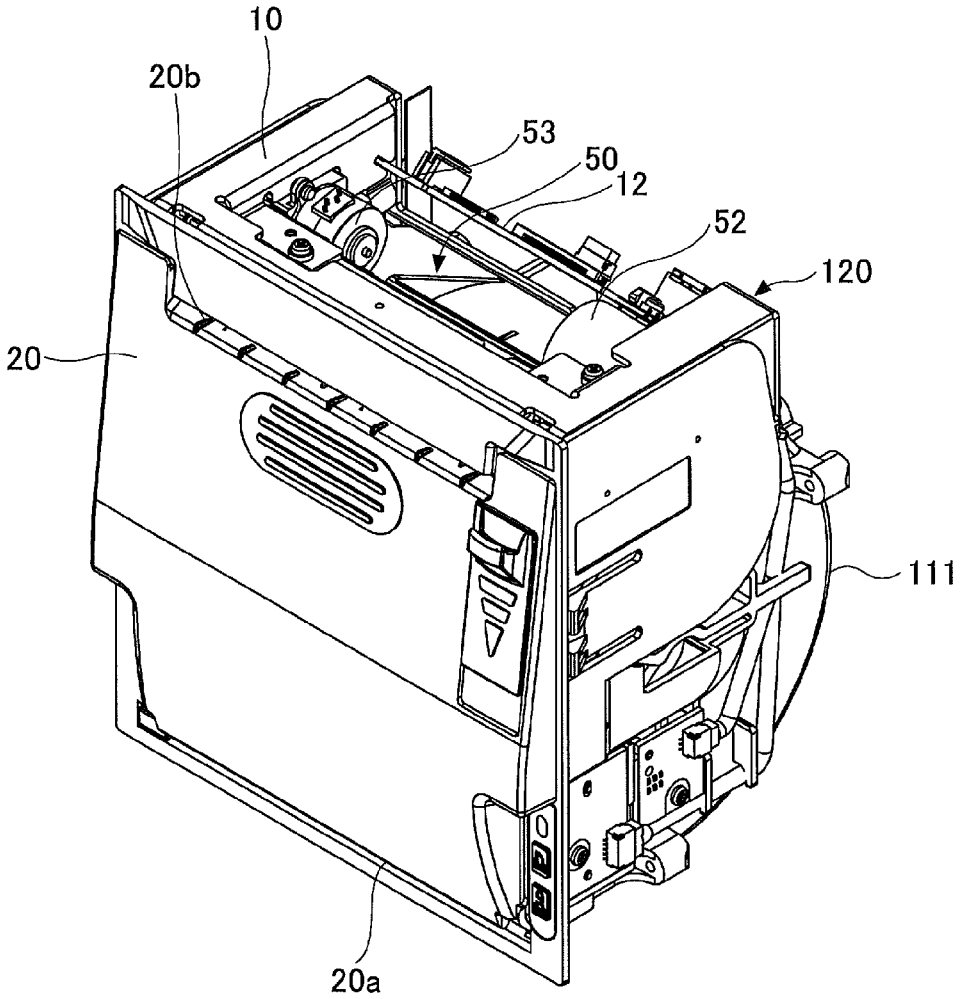
FIG. 4 is a perspective view of the printer with the lid closed according to the embodiment.

FIGS. 1 through 3 are perspective views of the printer with the lid opened, taken from different directions. FIG. 4 is a perspective view of the printer with the lid closed.

According to this embodiment, the printer is of a clamshell type, and includes a printer body 10 and a lid 20. The printer body 10 includes a recording paper holder 110 that defines a space for loading a roll of recording paper. A first end 20*a* of the lid 20 is connected to the printer body 10 in such a manner as to allow the lid 20 to be opened and closed relative to the printer body 10. That is, a rotation shaft provided on part of the lid 20 near the first end 20*a* is connected to the printer body 10, and the lid 20 is opened and closed relative to the printer body 10 by rotating the lid 20 about the rotation shaft.

According to this embodiment, at the time of using the printer, a roll of recording paper is placed inside the recording paper holder 110 of the printer body 10, and the lid 20 is closed as illustrated in FIG. 4. As a result, printing is ready to be performed on the recording paper in the printer.

The printer includes a thermal head 30 provided in the printer body 10. The thermal head 30 operates as a print head. The printer includes a platen roller 40 provided on the lid 20. The printer also includes a fixed blade 51 provided in the printer body 10 and a movable blade 61 provided on the lid 20. The printer further includes a conveyance motor 52 for rotating the platen roller 40 to convey the recording paper, and a movable blade motor 53 for driving the movable blade 61. The conveyance motor 52 and the movable blade motor 53 are provided in the printer body 10. The platen roller 40 and the movable blade 61 are provided near a second end 20*b* of the lid 20.

According to the printer, by closing the lid 20, the recording paper is held between the thermal head 30 and the platen roller 40, and is held between the fixed blade 51 and the movable blade 61. Thus, by closing the lid 20, the fixed blade 51 and the movable blade 61 are placed at predetermined positions to form a cutter, so that printing and cutting are ready to be performed on the recording paper. The printer further includes a control board 12 provided outside the printer body 10. The control board 12 is for controlling the printer.

Figure 5A:
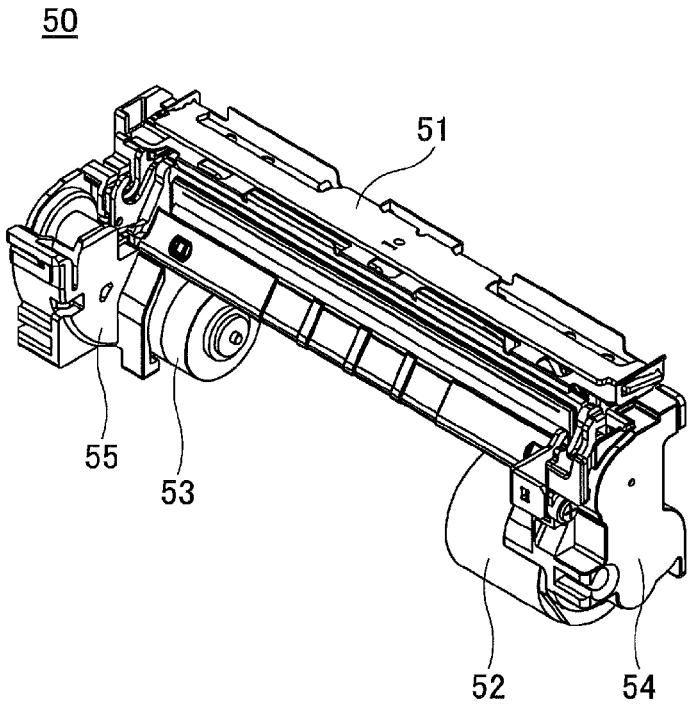
FIGS. 5A and 5B are diagrams illustrating a fixed blade unit of the printer according to the embodiment.
Figure 5B:
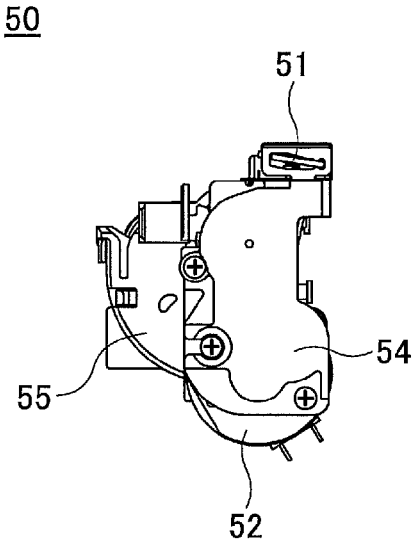

The printer includes a fixed blade unit 50 provided in the printer body 10. The fixed blade unit 50 includes the fixed blade 51. FIG. 5A is a perspective view of the fixed blade unit 50. FIG. 5B is a side view of the fixed blade unit 50. The fixed blade unit 50 includes the fixed blade 51, the conveyance motor 52, the movable blade motor 53, a conveyance gear box 54, and a movable blade gear box 55. The conveyance gear box 54 covers multiple conveyance gears provided inside the conveyance gear box 54. The movable blade gear box 55 covers multiple movable blade gears provided inside the movable blade gear box 55.

The platen roller 40 is rotated via the conveyance gears inside the conveyance gear box 54 by rotating the conveyance motor 52. The movable blade 61 is slid via the movable blade gears inside the movable blade gear box 55 by rotating the movable blade motor 53.

The conveyance gear box 54 and the movable blade gear box 55 are die castings made of zinc. The conveyance gear box 54 and the movable blade gear box 55 are positioned at a first longitudinal end and a second longitudinal end of the fixed blade unit 50, respectively.

Figure 6A:
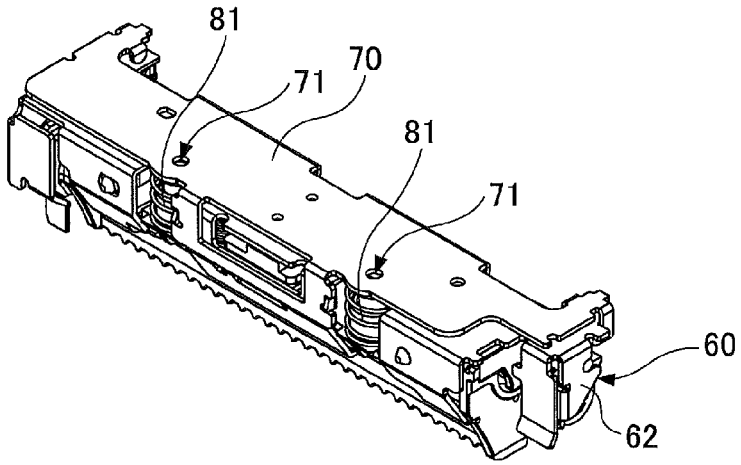
FIGS. 6A and 6B are diagrams illustrating a movable blade unit of the printer according to the embodiment.
Figure 6B:
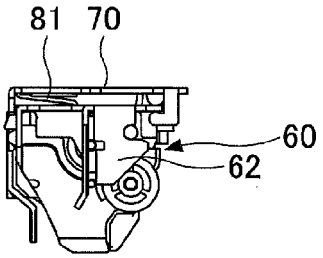
Figure 7:
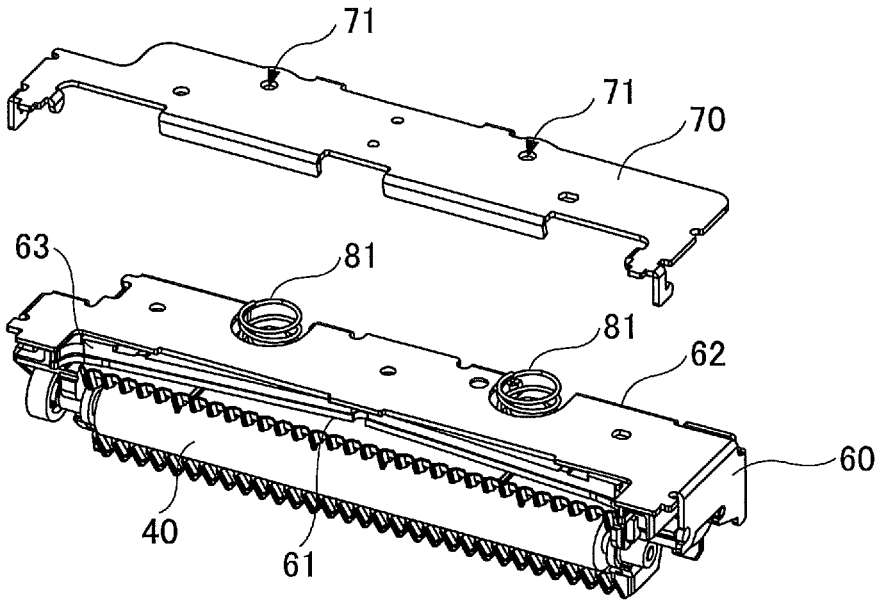
FIG. 7 is a diagram illustrating the movable blade unit of the printer according to the embodiment.

Furthermore, the printer includes a movable blade unit 60 as illustrated in FIGS. 6A, 6B and 7 provided near the second end 20*b* of the lid 20. The movable blade unit 60 includes the movable blade 61. FIG. 6A is a perspective view of the movable blade unit 60. FIG. 6B is a side view of the movable blade unit 60. FIG. 7 is a perspective view of the movable blade unit 60 with the platen roller 40 attached to and a gimbal plate 70 removed from the movable blade unit 60.

The movable blade unit 60 includes a movable blade unit housing 62. The movable blade unit housing 62 in its entirety is formed by bending a metal plate of stainless steel or the like. The movable blade 61 is provided inside the movable blade unit housing 62. The gimbal plate 70 is connected to the movable blade unit 60 on the side on which the movable blade unit 60 is attached to the lid 20. Two coil springs 81 are provided so as to intervene between the gimbal plate 70 and the movable blade unit 60. According to this embodiment, a screw is inserted through each of two attachment holes 71 formed in the gimbal plate 70, and the gimbal plate 70 is screwed to the lid 20 with the screws, so that the movable blade unit 60 is attached to the lid 20. Each attachment hole 71 is provided so as to align with the axial center of the corresponding coil spring 81.

The movable blade unit 60 is described in more detail with reference to FIG. 7. The gimbal plate 70 is formed by processing a metal plate of stainless steel or the like. The movable blade unit 60 includes a rack 63, and the movable blade 61 is attached to the rack 63. The movable blade 61 is slid together with the rack 63 via the movable blade gears in the movable blade gear box 55 by rotating the movable blade motor 53 in the fixed blade unit 50.

Figure 8A:
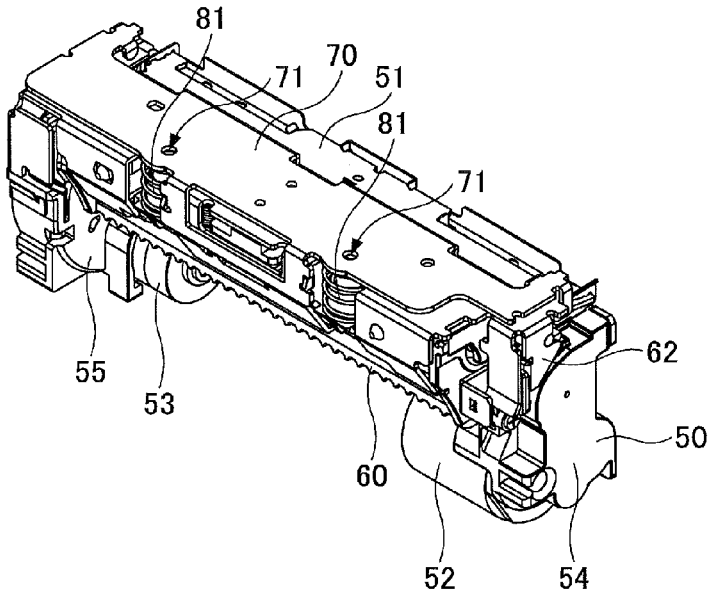
FIGS. 8A and 8B are diagrams illustrating the fixed blade unit and the movable blade unit of the printer in a connected state according to the embodiment.
Figure 8B:
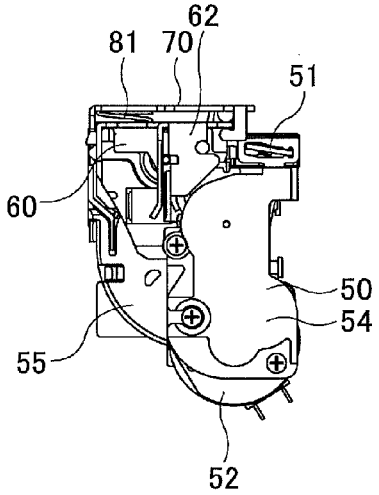

The fixed blade 51 and the movable blade 61 form a cutter. By closing the lid 20, the fixed blade unit 50 illustrated in FIGS. 5A and 5B and the movable blade unit 60 illustrated in FIGS. 6A and 6B are connected as illustrated in FIGS. 8A and 8B. FIGS. 8A and 8B are a perspective view and a side view, respectively, of the fixed blade unit 50 and the movable blade unit 60 with the lid 20 closed in the printer.

Next, the printer body 10 is described with reference to FIGS. 9A through 12. The printer body 10 includes the recording paper holder 110 having a space for placing a roll of recording paper and a body connecting metal member 120 attached to the recording paper holder 110.

Figure 9A:
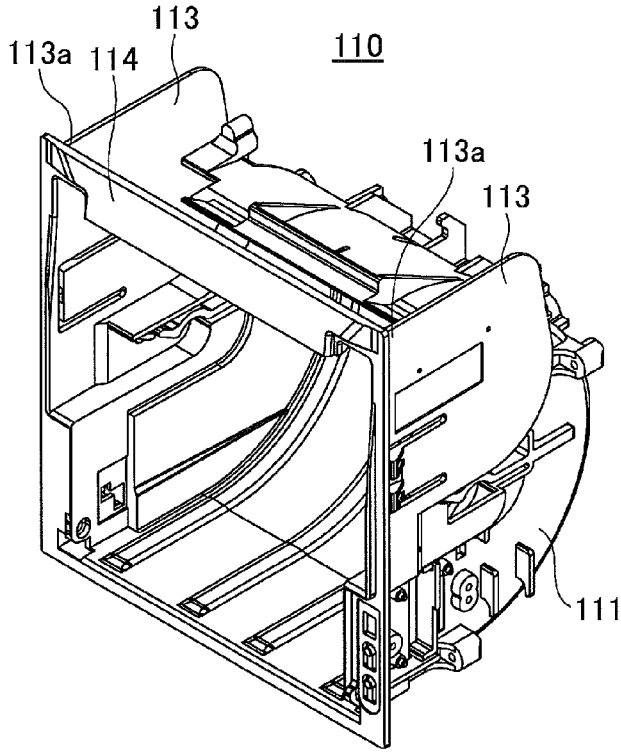
FIGS. 9A and 9B are perspective views of a recording paper holder.
Figure 9B:
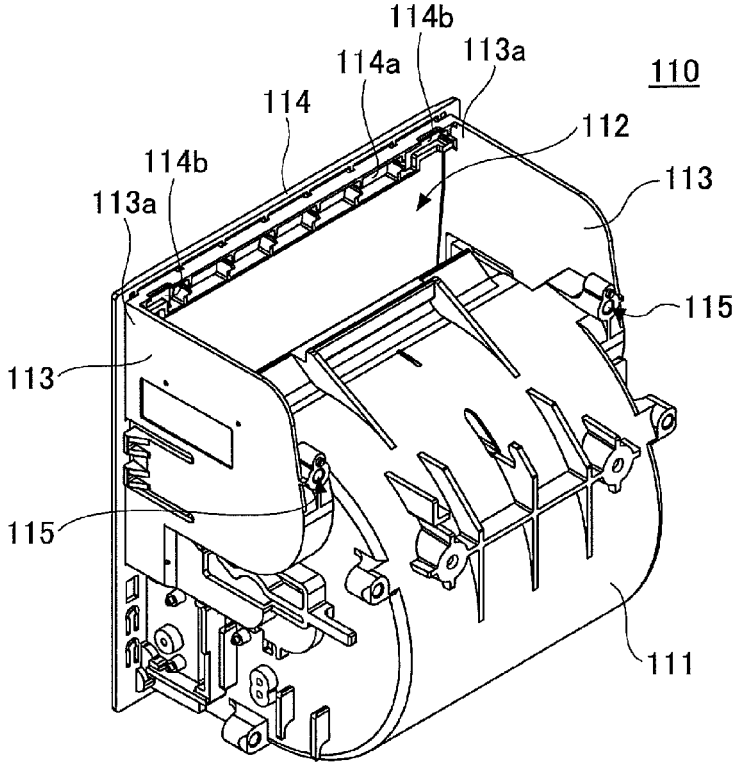

FIGS. 9A and 9B are perspective views of the recording paper holder 110, taken from different directions. As illustrated in FIGS. 9A and 9B, the recording paper holder 110 includes a holder part 111, two side plates 113 each connected to the holder part 111, and a bar-shaped connecting part 114 that connects respective ends 113*a* of the two side plates 113. A space for placing a roll of recording paper is formed inside the holder part 111. The thermal head 30 and the movable blade unit 50 including the fixed blade 51, the conveyance motor 52, and the movable blade motor 53 as illustrated in FIGS. 5A and 5B are provided on the body connecting metal member 120 outside the holder part 111 as illustrated in FIGS. 1 through 4.

A rectangular wide opening, referred to as "print opening 112," is formed in part of the recording paper holder 110 where the thermal head 30 and the fixed blade unit 50 are provided. The print opening 112 has a length corresponding to the width of the recording paper and has a width corresponding to, for example, the height (vertical dimension in FIG. 5B) of the fixed blade unit 50. The print opening 112 is thus provided in order to make it possible to perform printing on the recording paper by the thermal head 30 and to cut the recording paper with the fixed blade 51 and the movable blade 61 when the lid 20 is closed. That is, the print opening 112 is thus provided in order to make it possible, by closing the lid 20, to hold the recording paper between the platen roller 40 on the lid 20 and the thermal head 30 in the printer body 10 and to hold the recording paper by the movable blade 61 on the lid 20 and the fixed blade 51 in the printer body 10.

The print opening 112 is a substantially rectangular area defined by the holder part 111, the side plates 113, and the connecting part 114. Two attachment holes 115 for fixing the below-described body connecting metal member 120 to the recording paper holder 110 by, for example, screwing are provided outside the holder part 111 in the recording paper holder 110.

As described above, making the recording paper holder 110 of a material having high strength, such as a metal, would result in an increase in cost because the recording paper holder 110 has a complicated shape. Accordingly, the recording paper holder 110 is formed of a resin material, which is lower in cost and is easily formable into a desired shape. Therefore, the holder part 111, the side plates 113, and the connection part 114 that form the recording paper holder 110 also are formed of a resin material. A thinner connecting part 114 is preferable in terms of reducing the size of the printer. A thinner connecting part 114, however, is more likely to bend and break.

Figure 10A:
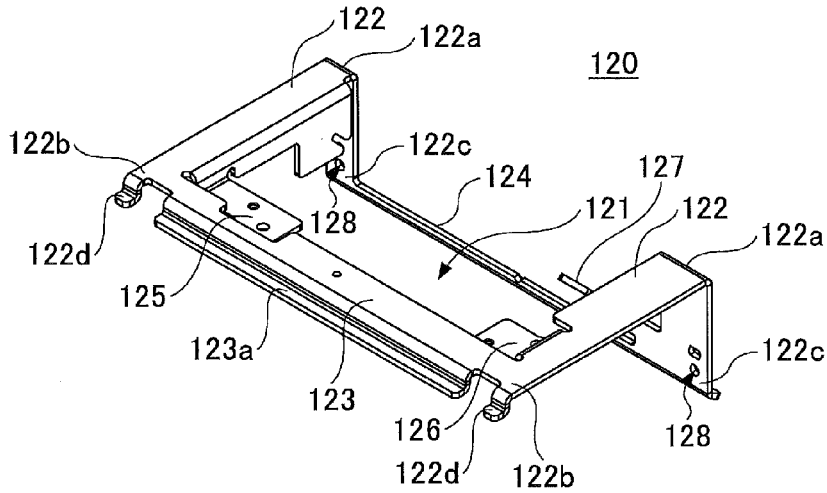
FIGS. 10A and 10B are perspective views of a body connecting metal member.
Figure 10B:
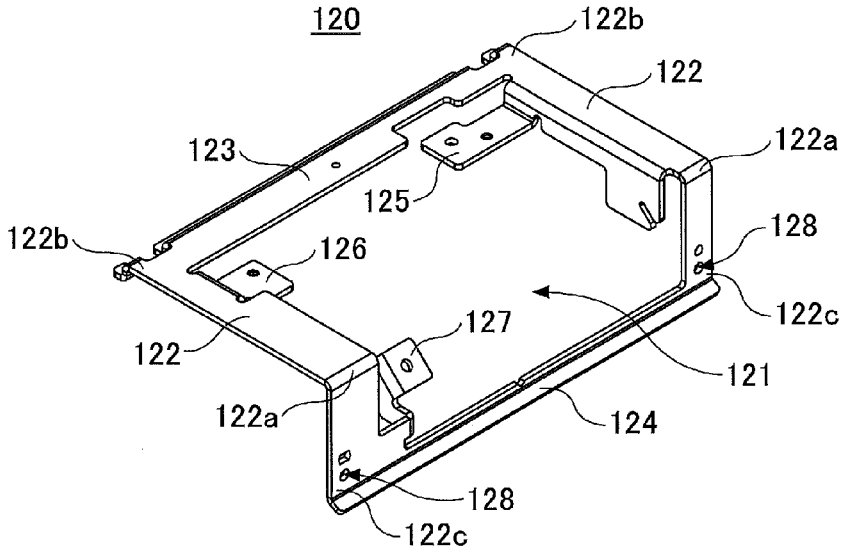
Figure 11A:
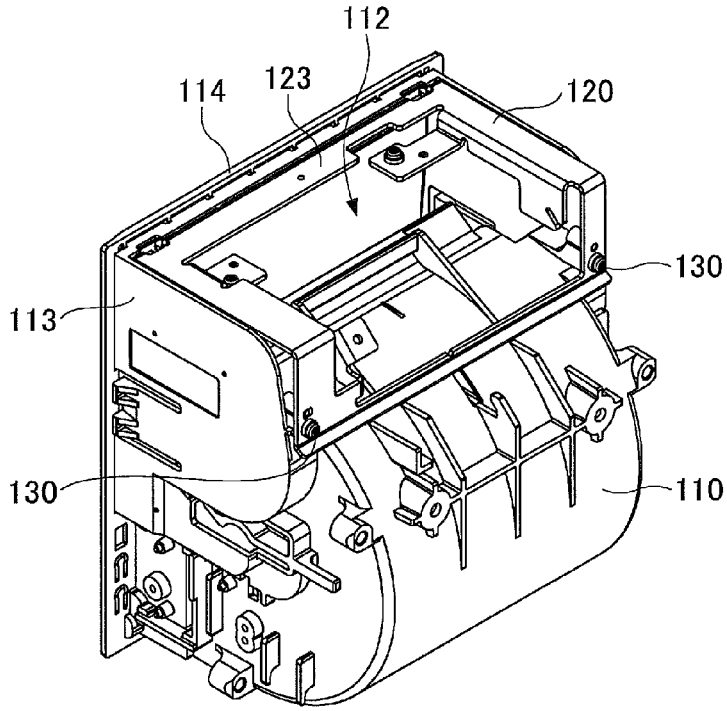
FIGS. 11A and 11B are perspective views of the recording paper holder to which the body connecting metal member is attached.
Figure 11B:
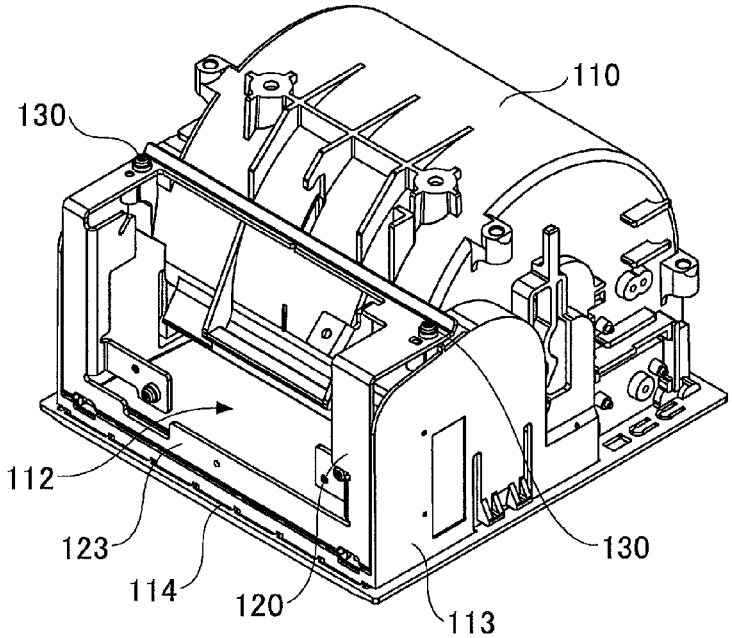
Figure 12:
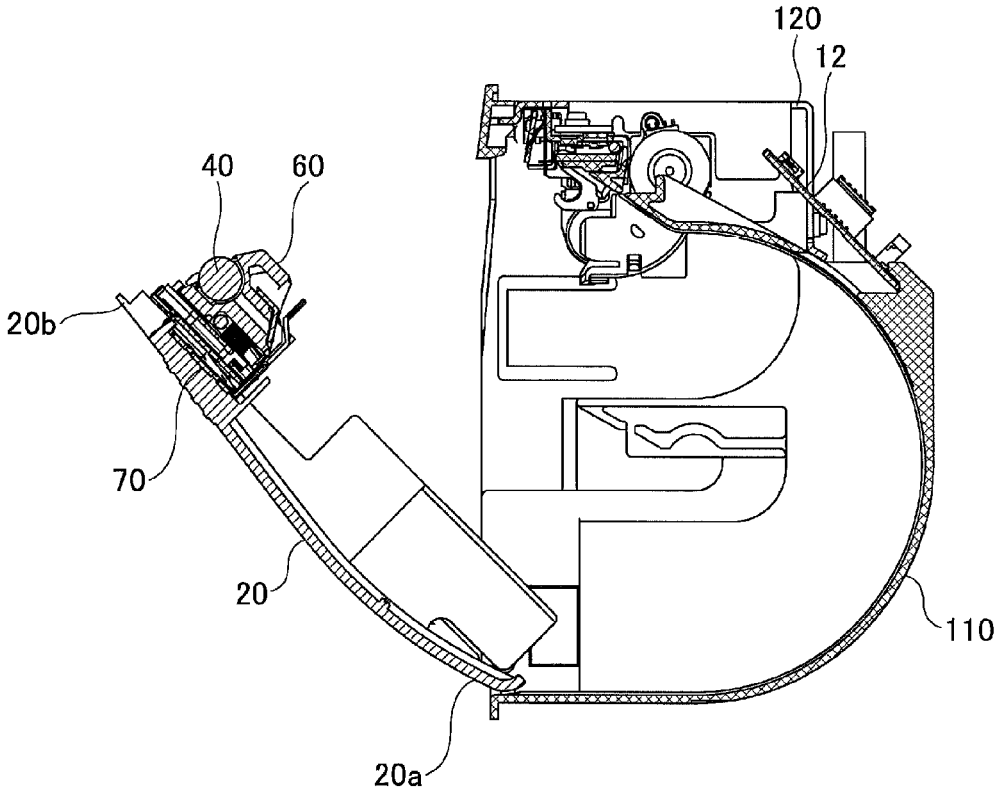
FIG. 12 is a cross-sectional view of the printer with the lid opened according to the embodiment.

FIGS. 10A and 10B are perspective views of the body connecting metal member 120, taken from different directions. FIGS. 11A and 11B are perspective views of the recording paper holder 110 to which the body connecting metal member 120 is attached, taken from different directions. FIG. 12 is a cross-sectional view of the printer.

The printer includes the body connecting metal member 120 illustrated in FIGS. 10A and 10B. As illustrated in FIGS. 11A and 11B, the body connecting metal member 120 is attached to the recording paper holder 110. By thus attaching the body connecting metal member 120 to the recording paper holder 110, it is possible to increase the strength of part of the recording paper holder 110 around the print opening 112 including the connecting part 114.

The body connecting metal member 120 is formed by processing a metal plate of stainless steel or the like, that is, by blanking out a metal plate of a desired shape and bending the blanked-out metal plate. A connecting metal plate opening 121 is formed in the center of the body connecting metal member 120. That is, the body connecting metal member 120 includes two side parts 122, a reinforcing part 123, and a connecting part 124, and the connecting metal plate opening 121 is an area defined by the side parts 122, the reinforcing part 123, and the connecting part 124.

The side parts 122 are opposite to each other across the connecting metal plate opening 121. Each of the side parts 122 is bent at a right angle at a bent portion 122*a* so as to have an L shape. The side parts 122 have respective first ends 122*b* connected by the reinforcing part 123 and have respective second ends 122*c* connected by the connecting part 124. Accordingly, the reinforcing member 123 and the connecting part 124 are opposite to each other across the connecting metal member opening 121.

A first placement part 125 projects in the connecting metal plate opening 121 from one of the side parts 122. A second placement part 126 and a third placement part 127 project in the connecting metal plate opening 121 from the other of the side parts 122. The first placement part 125 and the second placement part 126 are provided for placing the fixed blade unit 50. The first and second placement parts 125 and 126 are formed by bending metal plates extending from the side parts 122 into desired shapes. Furthermore, the third placement part 127 is provided for placing the control board 12, and is formed by bending a metal plate extending from the other of the side parts 122 into a desired shape. Attachment holes for screwing the fixed blade unit 50 are provided in the first and second placement parts 125 and 126, and an attachment hole for screwing the control board 12 is provided in the third placement part 127. Furthermore, attachment holes 128 for fixing the body connecting metal member 120 to the recording paper holder 110 are provided in the side parts 122.

The body connecting metal member 120 is fixed to the recording paper holder 110 as illustrated in FIGS. 11A and 11B by driving screws 130 into the attachment holes 115 of the recording paper holder 110 through the attachment holes 128 of the body connecting metal member 120. As a result, the connecting part 114 of the recording paper holder 110 and the reinforcing part 123 of the body connecting metal member 120 come into contact, and the side plates 113 are covered with the side parts 122 of the body connecting metal member 120.

Thus, as a result of the connecting part 114 of the recording paper holder 110 and the reinforcing part 123 of the body connecting metal member 120 coming into contact, the connecting part 114 formed of a resin material is supported by the reinforcing member 123 formed of a metal material. That is, according to this embodiment, even when a load is applied to the connecting part 114 of the recording paper holder 110, the connecting part 114 is supported by the reinforcing member 123 formed of a metal material having high strength. Accordingly, the connecting part 114 of the recording paper holder 110 is prevented from deforming, so that it is possible to prevent breakage of the printer.

For example, at the time of attaching the body connecting metal member 120 to the recording paper holder 110, an end 123*a* of the reinforcing member 123 of the body connecting metal member 120 may enter a groove 114*a* formed in the connecting part 114 of the recording paper holder 110, so that the connecting part 114 formed of a resin material may be supported by the reinforcing member 123 formed of a metal material. Furthermore, hooks 122*d* formed at the first ends 122*b* of the side parts 122 of the body connecting metal member 120 may enter grooves 114*b* formed in the connecting part 114 of the recording paper holder 110.

If the fixed blade unit 50 were provided directly on the recording paper holder 110 formed of a resin material, the recording paper holder 110 could deform. According to this embodiment, however, the fixed blade unit 50 is fixed with screws or the like to the first and second placement parts 125 and 126 of the body connecting metal member 120 formed of a metal material having high strength. The body connecting metal member 120 to which the movable blade unit 50 is fixed has high strength. Therefore, the body connecting metal member 120 is prevented from being deformed by the weight of the fixed blade unit 50, so that it is possible to prevent deformation of the recording paper holder 110 and breakage of the printer.

Likewise, if the control board 12 were provided directly on the recording paper holder 110 formed of a resin material, the recording paper holder 110 could deform because of the weight of the control board 12. According to this embodiment, however, the control board 12 is fixed with a screw or the like to the third placement part 127 of the body connecting metal member 120 formed of a metal material having high strength. The body connecting metal member 120 to which the control board 12 is fixed has high strength. Therefore, the body connecting metal member 120 is prevented from being deformed by the weight of the control board 12, so that it is possible to prevent deformation of the recording paper holder 110 and breakage of the printer.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a printer body that includes a print head;

a recording paper holder in which recording paper is placed; and a metal member fixed to the recording paper holder;

a lid connected to the printer body so as to be opened and closed relative to the printer body;

a cutter including a fixed blade and a movable blade that cuts the recording paper;

a fixed blade unit provided on the metal member of the printer body, the fixed blade unit including the fixed blade; and a movable blade unit provided on the lid, the movable blade unit including the movable blade.

2. The printer as claimed in claim 1, wherein the recording paper holder includes a holder inside which the recording paper is placed;

first and second side plates connected to the holder;

a first connecting part that connects an end of the first side plate and an end of the second side plate; and an opening defined by the holder, the first and second side plates, and the first connecting part, wherein the metal member includes first and second side parts;

a reinforcing part that connects a first end of the first side part and a first end of the second side part; and a second connecting part that connects a second end of the first side part and a second end of the second side part, and the first connecting part is in contact with the reinforcing part of the metal member with the metal member being fixed to the recording paper holder.

3. The printer as claimed in claim 1, wherein the fixed blade unit further includes a conveyance motor, a movable blade motor, a conveyance gear box, and a movable blade gear box, a platen roller is provided on the movable blade unit, the platen roller is rotated by the conveyance motor via gears in the conveyance gear box, and the movable blade is driven by the movable blade motor via gears in the movable blade gear box.

* * * * *